US005489026A

United States Patent [19]

D'Aloia

[11] Patent Number: 5,489,026

[45] Date of Patent: Feb. 6, 1996

[54] CARTONLESS PACKAGING SYSTEM

[75] Inventor: Gaétan D'Aloia, Neuchatel, Switzerland

[73] Assignee: Allergan, Inc., Irvine, Calif.

[21] Appl. No.: 280,008

[22] Filed: Jul. 25, 1994

[51] Int. Cl.[6] ..... B65D 23/12

[52] U.S. Cl. ..... 206/570; 206/528; 215/6; 215/228; 220/212; 220/522

[58] Field of Search ..... 215/6, 228; 220/522, 220/521, 212; 206/570, 216, 223, 531, 532, 535, 538, 539, 528

[56] References Cited

U.S. PATENT DOCUMENTS

| | | | |
|---|---|---|---|
| 2,250,666 | 7/1941 | Godefroy | 215/46 |
| 2,276,678 | 3/1942 | Wheeler | 65/13 |
| 2,694,641 | 11/1954 | Atwood et al. | 99/78 |
| 3,433,378 | 3/1969 | Ross | 215/6 |
| 3,893,280 | 7/1975 | King | 53/37 |
| 4,432,455 | 2/1984 | Savoir | 206/531 |
| 4,776,972 | 10/1988 | Barrett | 252/90 |
| 4,785,931 | 11/1988 | Weir et al. | 215/6 X |
| 4,856,647 | 8/1989 | Pahne | 206/5.1 |
| 5,114,011 | 5/1992 | Robbins, III | 206/499 |
| 5,127,517 | 7/1992 | Clements et al. | 206/5.1 |
| 5,223,245 | 6/1993 | Ibrahim et al. | 215/228 X |
| 5,318,183 | 6/1994 | Cohen et al. | 215/6 X |

*Primary Examiner*—Jacob K. Ackun
*Attorney, Agent, or Firm*—Walter A. Hackler

[57] ABSTRACT

A cartonless packaging system is provided which significantly reduces packaging waste and includes a container for containing a liquid and a nozzle dis posed in one end of the container for dispensing of the liquid from the container. A cap is provided for enclosing the nozzle, and the cap is configured for being removably attached to the container. A support system is provided which encircles the nozzle for removably supporting a plurality of tablets with the support being disposed beneath the cap means when the cap means is attached to the container. In addition, instructional materials are incorporated into the car tonless packaging system, and thus no separate packaging materials are necessary for providing the separate elements to the consumer.

10 Claims, 1 Drawing Sheet

CARTONLESS PACKAGING SYSTEM

The present invention is generally directed to a cartonless packaging system and more particularly directed to a cartonless package for liquids and tablets.

Environmental concerns throughout the world have created a need for cartonless packaging and some countries, especially in Central Europe, have passed "Green" regulations regarding allowable waste in connection with the packaging of goods, particularly for consumer products.

Regulations for the reduction of packaging waste have particular significance with regard to multicomponent goods; i.e., goods in which a combination of products is sold in one carton or package which, upon opening of the package, are to be used in combination by the consumer, either serially or in parallel.

As a specific example, many ophthalmic products, particularly contact lens cleaning and sterilizing solutions are sold in multicomponent kits. More particularly in this regard, a liquid solution may be sold for the cleaning of contact lenses along with neutralizing tablets to be added to the cleaning solution following treatment of the contact lenses with the solution.

Naturally, this type of system is not sold as a single component; rather, a package is provided the consumer which includes a solution and tablets for use in conjunction with the cleaning of contact lenses.

The plurality of such components inherently presents a packaging problem.

Without environmental concerns, this packaging problem is easily solved by providing separate packaging devices such as envelopes, pouches, containers and the like which are incorporated into a larger overall package for holding each of the components, or products, in a convenient manner for use by the consumer. However, this often represents a duplication in packaging materials which are ultimately disposed by the consumer and become a concern for waste management systems and procedures concomitant therewith.

Therefore, it is desirable to develop a packaging for multicomponent consumer products which eliminates or greatly reduces the intermediate packaging of items in order to reduce waste due to discarding of such packaging. The present invention fills this need by providing a cartonless packaging system for both tablets and a liquid with minimal packaging waste.

SUMMARY OF THE INVENTION

A cartonless packaging system in accordance with the present invention generally includes a container which provides means for containing a liquid and nozzle means, disposed at one end of the container, for dispensing of the liquid from the container.

A cap provides means for enclosing the nozzle means and the cap is configured for being removably attached to the container. Importantly, support means is provided which encircles the nozzle means and functions to removably the support a plural ity of tablets. Because the support means is disposed beneath the cap, when the cap is attached to the container, a significant reduction in packaging materials is effected.

In one embodiment of the present invention, a support means comprises at least one doughnut-shaped wafer having means, defining a central aperture, for removably attaching the wafer to the nozzle means. In order to stabilize the wafer onto the nozzle means, the cap includes. a depending member which provides means for preventing the wafer from detachment from the nozzle when the cap is attached to the container means. This feature enables the container with cap in place to be handled without the possibility that the wafer supporting the tablets would become loose and therefore possibly separate from the nozzle when the cap is removed to. gain access to both the tablets and for dispensing of the liquid.

More partichlarly, a rupturable material is attached to the wafer and provides means for holding the tablets between the rupturable material and the wafer. In addition, perforations may be provided in the wafer between the tablets which provides a means for facilitating the removal of the tablets, one at a time, from the wafer to be used as needed by the consumer. Importantly, the tablets may be disposed in a circular array around the central aperture to facilitate handy access thereto by the user.

BRIEF DESCRIPTION OF THE DRAWINGS

The advantages and features of the present invention will be better understood by the following description when considered in conjunction with the accompanying drawings in which.

DETAILED DESCRIPTION

Figure 1:
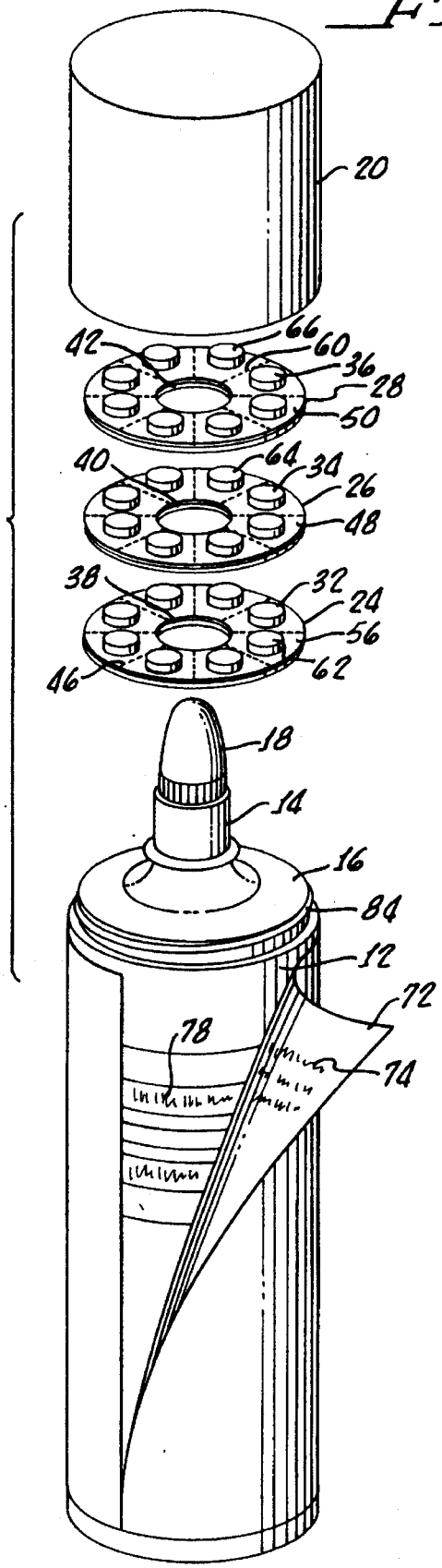
FIG. 1 is a perspective view of one embodiment of the present invention partially exploded to show a container, a nozzle and a plurality of doughnut-shaped wafers for supporting a plurality of wafers beneath a cap.

Turning now to FIG. 1, there is shown a cartonless packaging system 10, in accordance with the present invention, generally including a container 12 which provides means for containing a liquid, such as, for example, a contact lens cleaning solution; a nozzle 14 disposed on one end 16 of the container 12 which provides a means for dispensing of the liquid (not shown) from the container 12; and a cap 20 which provides means for enclosing the nozzle 14. Preferably, the container 12 is formed from a suitable plastic material to enable squeezing thereof to facilitate dispensing of liquid through the nozzle 14. As will be hereinafter discussed in greater detail, the cap 20 is configured for being removably attached to the container 12. A separate cover 18 may be provided for sealing the nozzle 14.

One or more doughnut-shaped wafers 24, 26, 28 may be utilized to provide a support means for removably supporting a plurality of tablets 32, 34, 36.

Each of the wafers 24, 26, 28 include central apertures 38, 40, 42 which provide a means for removably attaching each of the wafers 24, 26, 28 to the nozzle 14.

Figure 3:
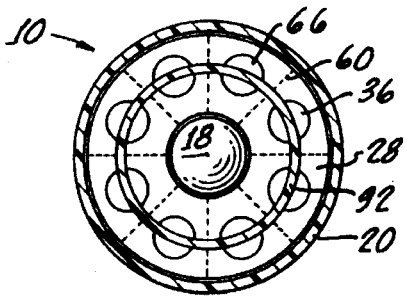
FIG. 3 is a cross-sectional view taken along the lines 3—3 of FIG. 2, showing the circular array of the tablets around the nozzle.
Figure 2:
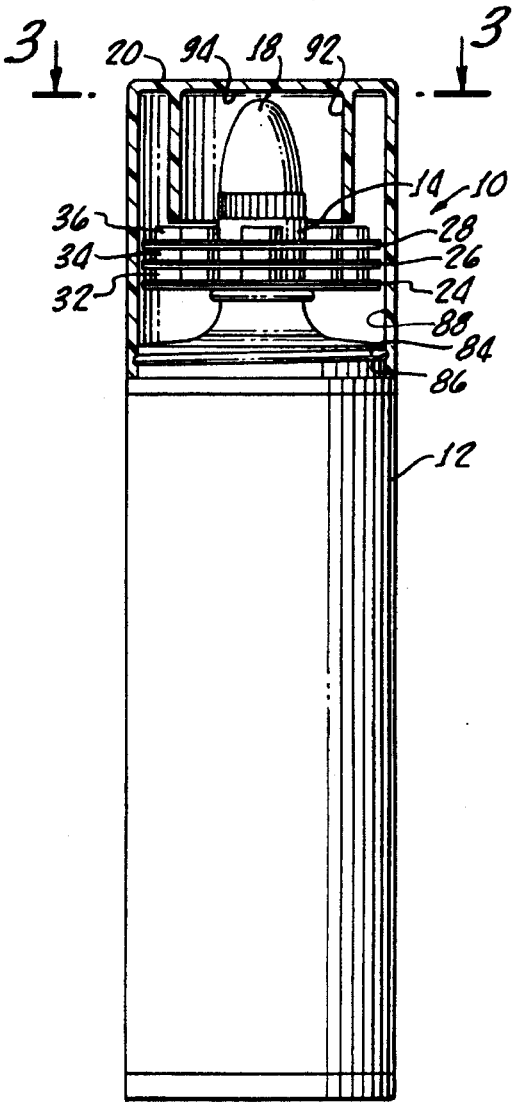
FIG. 2 is a cross-section of the embodiment shown in FIG. 1, particularly illustrating this embodiment fully assembled with internal depending members of the cap retaining the wafers around a nozzle.

As more clearly shown in FIGS. 2 and 3, each of the wafers 24, 26, 28 are sized with an outside diameter for enabling their disposition beneath the cap 20 when the cap 20 is attached to the container 12.

Turning again to FIG. 1, a clear plastic, or foil (not shown), 46, 48, 50 may be provided and attached respectively to wafers 24, 26, 28 for holding tablets 32, 34, 36 to the associated wafers 24, 26, 28 in a "blister pack" manner between the plastic 46, 48, 50 and associated wafers 24, 26, 28. Thus, the plastic 46, 48, 50 provides a rupturable means or members for holding the tablets 32, 34, 36 to the respective wafers 24, 26, 28.

As also shown in FIG. 1,the tablets 32, 34, 36 are preferably disposed in a circular array on the wafers 24, 26, 28 around the apertures 36, 40, 42 in order to facilitate dense packing thereof and direct access to the user. In addition, perforations 56, 58, 60 may be provided between adjacent tablets 32, 62, 34, 64 and 36, 66 which provide means for further facilitating removal of the tablets 32, 34, 36, 62, 64, 66, one at a time, from the respective wafers 24, 26, 28.

With further reference to FIG. 1 there is shown a removable outer sleeve 72 surrounding the container 12 on which printed instructions 74 may be provided as to the use of the liquid (not shown) in the container and tablets 32, 34, 36, 62, 64, 66. Further instructional materials may be printed as indicated by the indicia 78 directly on the container 12.

Because the sleeve 72 is integral with the container until use, no separate packaging is necessary for the sleeve 72 with instructional indicia 74 printed thereon. In this manner, a separate container (not shown) is eliminated which otherwise would be necessary for holding the container 12 and the sleeve 72. Similarly, because the tablets supporting wafers 56, 58, 60 are disposed around the nozzle 14 and beneath the cap 20, no separate packaging is required therefor. Hence, the packaging system 10 is, in effect, "cartonless" since no separate carton, package or enclosure device is necessary to gather and support the container 12; tablets 32, 34, 36; and instructional sleeve 72.

Turning now to FIG. 2, the cap 20 is shown removably attached to container 12 by means of a ridge 84 and a detent 86 in an inner surface 88 of the cap 20. Also shown is a concentric member 92 depending from a top inside surface 94 of the cap 20 which provides a means for preventing the wafers 24, 26, 28 from detachment from the nozzle 14 when the cap 20 is attached to the container 12, as shown in FIG. 2. Thus, rough handling of the assembled packaging system 10 will not dislodge the wafers 24, 26, 28 from the nozzle 14 which may result in spilling of the wafers 24, 26, 28 from the cap 20 when the cap is removed.

Although there has been hereinabove described a specific arrangement of a cartonless packaging system in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A cartonless packaging system comprising:

container means for containing a liquid;

nozzle means, disposed in one end of said container means, for dispensing of the liquid from the container;

cap means for enclosing said nozzle means, said cap means being configured for being removably attached to said container means; and support means, attached to and encircling said nozzle means, for removably supporting a plurality of tablets, said support means being disposed within said cap means when said cap means is attached to said container means.

2. The cartonless packaging system according to claim 1 wherein said support means comprises at least one doughnut-shaped wafer having means, defining a central aperture, for removably attaching the wafer to said nozzle means.

3. The cartonless packaging system according to claim 2 further comprising rupturable means, attached to the wafer, for holding the tablets between the rupturable means and the wafer.

4. The cartonless packaging system according to claim 3 wherein said cap means includes depending member means for preventing the wafer means from detachment from the nozzle means when the cap means is attached to said container means.

5. The cartonless packaging system according to claim 4 wherein said tablets are disposed in a circular array around the central aperture.

6. The cartonless packaging system according to claim 5 comprising means, defining perforation in the wafer between tablets, for facilitating removal of the tablets, one at a time, from the wafer.

7. A cartOnless packaging system comprising:

squeezable container means for containing a liquid, said container means being circular in cross-section and having a tip and a bottom end;

nozzle means, disposed in the container means top end, for dispensing of the liquid from the container upon squeezing of the container;

cap means for enclosing said nozzle means, said cap means having an outside diameter equal to an outside diameter of the container means and having detent means, disposed on an inside surface of said cap means, for removably attaching said cap means to said container means;

a plurality of doughnut-shaped wafers attached to and encircling said nozzle means, for removably supporting a plurality of tablets, the wafers, being disposed beneath said cap means when said cap means is attached to said container means, said support means further comprising a plurality of rupturable means, one attached to each wafer, for holding the tablet between each rupturable means and an associated wafer;

means, defining perforations in each wafer between tablets, for facilitating removal of the tablets, one at a time, from each wafer; and means, disposed in said cap means, for preventing the wafers from detachment from the nozzle means when the cap means is attached to said container means.

8. A cartonless packaging system comprising:

a container means for containing a liquid; nozzle means, disposed in one end of said container means, for dispensing of the liquid from the container;

support means, attached to and enciroling said nozzle means, for removably supporting a plurality of tablets; and cap means for enclosing both said nozzle means and said support means, said cap means being configured for being removably attached to said container means.

9. The cartonless packaging system according to claim 8 wherein said cap means includes depending member means for preventing the wafer means from detachment from the nozzle means when said cap means is attached to said container means.

10. The cartonless packaging system according to claim 9 wherein said depending member means comprises a concentric member depending from a top inside surface of said cap means.

* * * * *